US006213191B1

(12) United States Patent
Nitzsche

(10) Patent No.: US 6,213,191 B1
(45) Date of Patent: Apr. 10, 2001

(54) SCREEN

(75) Inventor: Robert W. Nitzsche, Chicago, IL (US)

(73) Assignee: Steelcase Development Inc., Caledonia, MI (US)

( * ) Notice: Subject to any disclaimer, the term of this patent is extended or adjusted under 35 U.S.C. 154(b) by 0 days.

(21) Appl. No.: 09/239,606

(22) Filed: Jan. 29, 1999

(51) Int. Cl.[7] ..... A47G 5/00
(52) U.S. Cl. ..... 160/351; 160/127; 108/50.11
(58) Field of Search ..... 160/351, 135, 160/370.21, 405, 127; 108/50.11; 297/184.15

(56) References Cited

U.S. PATENT DOCUMENTS

| | | | | |
|---|---|---|---|---|
| 995,410 | | 6/1911 | McClure . | |
| 1,378,904 | | 5/1921 | Schuermann . | |
| 1,952,749 | | 3/1934 | Ellis | 45/75 |
| 2,131,214 | | 9/1938 | Bentz | 155/36.5 |
| 2,214,204 | | 9/1940 | Pollard | 155/128 |
| 2,292,785 | | 8/1942 | Henne | 40/125 |
| 2,470,416 | | 5/1949 | Silver | 41/4 |
| 2,942,924 | | 6/1960 | Stangert | 312/140.4 |
| 2,944,861 | | 7/1960 | Lessin | 312/196 |
| 2,981,583 | | 4/1961 | Eisenberg | 312/140.4 |
| 3,326,147 | | 6/1967 | Toney | 108/27 |
| 3,629,960 | | 12/1971 | Roush | 35/60 |
| 3,680,177 | | 8/1972 | Ginsberg | 24/73 PC |
| 3,748,006 | | 7/1973 | Levit et al. | 312/111 |
| 3,908,949 | | 9/1975 | Larson | 248/223 |
| 4,134,439 | | 1/1979 | Scott | 160/135 |
| 4,230,363 | * | 10/1980 | Borichevsky | 297/184.15 |
| 4,516,620 | | 5/1985 | Mulhern | 160/351 |
| 4,596,098 | | 6/1986 | Finkbeiner et al. | 52/220 |
| 4,600,173 | | 7/1986 | Frascaroli et al. | 248/68.1 |
| 4,784,205 | | 11/1988 | Johnson et al. | 160/351 |
| 4,825,892 | | 5/1989 | Norman | 135/104 |
| 4,932,177 | | 6/1990 | Hinden | 52/221 |
| 4,951,333 | | 8/1990 | Kaiser et al. | 5/417 |
| 4,986,330 | | 1/1991 | McGonagle | 160/135 |
| 4,986,505 | | 1/1991 | Zabawski et al. | 248/214 |
| 5,000,210 | * | 3/1991 | Worthington | 297/184.15 |
| 5,033,528 | | 7/1991 | Volcani | 160/351 |
| 5,038,539 | | 8/1991 | Kelley et al. | 52/239 |
| 5,056,172 | | 10/1991 | Kaiser et al. | 5/417 |
| 5,092,253 | | 3/1992 | Grund et al. | 108/101 |
| 5,103,741 | | 4/1992 | Grund et al. | 108/50 |
| 5,104,087 | | 4/1992 | Wentzloff et al. | 248/442.2 |
| 5,249,592 | | 10/1993 | Springer et al. | 135/104 |
| 5,301,705 | | 4/1994 | Zheng | 135/104 |
| 5,333,665 | | 8/1994 | Safar | 160/84.1 D |
| 5,381,908 | | 1/1995 | Hepp | 211/184 |
| 5,439,017 | | 8/1995 | Brown | 135/126 |
| 5,467,794 | | 11/1995 | Zheng | 135/125 |
| 5,490,357 | | 2/1996 | Lin | 52/220.7 |
| 5,509,112 | | 3/1997 | Meyer et al. | 108/153 |
| 5,609,112 | | 3/1997 | Meyer et al. | 108/50 |
| 5,611,380 | * | 3/1997 | Landy | 160/370.21 X |
| 5,655,670 | | 8/1997 | Stuart | 211/43 |
| 5,664,596 | | 9/1997 | Zheng | 135/126 |
| 5,673,632 | | 10/1997 | Sykes | 108/50 |
| 5,676,168 | | 10/1997 | Price | 135/126 |
| 5,722,477 | | 3/1998 | Richter et al. | 160/135 |
| 5,778,915 | | 7/1999 | Zheng | 135/126 |
| 5,816,279 | | 10/1998 | Zheng | 135/126 |
| 5,845,697 | * | 12/1998 | Zheng | 160/370.21 |
| 5,941,265 | * | 8/1999 | Zheng | 160/370.21 X |

* cited by examiner

*Primary Examiner*—David M. Purol
(74) *Attorney, Agent, or Firm*—Foley & Lardner

(57) ABSTRACT

A screen for use in a work environment providing a generally planar surface is disclosed. The screen includes a frame providing an outer perimeter tending to a first shape. The screen further includes a web at least partially circumscribed by the frame and having a shape at least partially defined by the shape of the outer perimeter of the frame. The screen also includes a mounting assembly configured to attach the frame to the surface.

55 Claims, 6 Drawing Sheets

20
42
46
72
48
68
44
60
166
166
164
164
50
52
64
58
62
56
177

116
118
114
112
4B
4B
120
128
178
130
126
110
122
116
130
128
124
114
112
118
116

100
42
30
132
120
40
48
102
72
170
5
5
120
134
44

SCREEN

FIELD OF THE INVENTION

The present invention relates generally to a screen for use in a work environment.

BACKGROUND OF THE INVENTION

It is generally known to divide a space provided within a work environment into one or more work spaces. According to such known arrangements, the work spaces may be further divided or otherwise arranged to create one or more work areas for use by individual workers or groups of workers who may be engaged in individual or group activities. It is also generally known to reconfigure such work areas within the work spaces by arrangement of one or more articles of furniture, such as panel walls, screens, worksurfaces (e.g., display surfaces, tables, display boards, etc.), storage units (e.g., closets, cabinets, filing systems, etc.), seating products, etc. in a manner intended to support workers in a wide variety of individual and group activities.

The dynamic work environment, characterized by a need for flexibility, reconfigurable work areas and an ability to support a wide variety of activities of both individual workers and project teams of varying sizes, has recently grown in prevalence. The dynamic work environment typically includes mobile articles of furniture. Individual and team spaces in the dynamic work environment are ideally capable of rapid configuration and reconfiguration by the workers themselves or by rearrangement of such mobile articles of furniture to support a variety of individual or group activities.

It is known to provide for a partition to provide physical space division or visual privacy in a work environment. For example, partition wall arrangements are well-known for use in a work environment to form work spaces and work areas. However, such known partition wall arrangements effectively "define" the work environment and associated work spaces in a semi-permanent manner after being installed (i.e., it is not readily possible for the workers themselves to reconfigure the work environment using such known partition wall arrangements). As a result, such known partition wall arrangements are not typically well-suited for use in a dynamic work environment.

According to other known arrangements, mobile structures (such as hanging panels or freestanding panels) may be used to provide physical space division or visual privacy in a work environment. However, such known structures typically must be stowed or put aside when not in use, which occupies space within the work environment that could possibly be used for more productive worker activity. Moreover, such mobile structures may not provide a suitable level of visual privacy when installed.

According to still other known arrangements, screens may be used to provide physical space division or visual privacy in a work environment. Known screens are typically floor-standing and may be characterized by a lightweight construction. Such known screens may have folding panel sections or may be made of one or more rigidly connected panel sections. However, such known screens are typically not designed for convenient storage or association with other articles of furniture within the work environment.

Accordingly, it would be advantageous to provide a screen for dividing space and offering visual privacy in a work environment that may be selectively mounted to an article of furniture. It would also be advantageous to provide a screen having a generally flexible frame and supported by a generally horizontal surface, such that the screen can readily be used to form work spaces of a variety of sizes and configurations or provide visual privacy in a work environment. It would further be advantageous to provide a method for selectively configuring a screen for compact storage in a work environment by deforming the shape of the screen. It would still further be advantageous to provide a method for selectively configuring a screen for use in a work environment by deforming the shape of the screen. It would also be advantageous to provide a method for providing selective privacy in a work environment by installing a screen on an article of furniture and positioning the screen.

SUMMARY OF THE INVENTION

The present invention relates to a screen for use in a work environment including a worksurface. The screen includes a flexible frame providing an outer perimeter defining a first shape. The screen also includes a web at least partially circumscribed by the frame and having a shape corresponding to the shape of the frame. The screen further includes a mounting assembly connected to the frame for attaching the screen to the worksurface.

The present invention further relates to a screen for use in a work environment providing a generally horizontal surface. The screen includes a generally flexible frame providing an outer perimeter that tends to a first shape. The screen further includes a web at least partially circumscribed by the frame and having a shape at least partially defined by the shape of the outer perimeter of the frame. The screen also includes a mounting assembly configured to support the frame on the generally horizontal surface.

The present invention further relates to a method for selectively configuring a screen for use in a work environment. The screen includes a frame having a top member, a bottom member, a first middle member and a second middle member. The frame provides an outer perimeter tending to a first shape. The screen further includes a web at least partially circumscribed by the frame and having a shape at least partially defined by the shape of the outer perimeter of the frame. The method includes detaching the frame from a mounting assembly. The method further includes deforming the frame into a second shape such that the first middle member and the second middle member are adjacent to each other. The method further includes deforming the frame into a third shape such that the frame includes a first hoop, a second hoop and a third hoop. The method still further includes positioning the second hoop adjacent the first hoop and the third hoop.

The present invention further relates to a method for selectively configuring a screen for use in a work environment. The work environment provides a generally horizontal surface. The screen includes a frame providing an outer perimeter tending to a first shape. The screen further includes a cover at least partially circumscribed by the frame and having a shape at least partially defined by the shape of the outer perimeter of the frame. The screen also includes a mounting assembly configured to attach the frame to the generally horizontal surface. The method includes detaching the frame from the mounting assembly. The method further includes deforming the frame into a second shape.

The present invention further relates to a method to provide selective privacy in a work environment. The work environment provides a screen. The screen includes a frame providing an outer perimeter tending to a first shape. The screen further includes a cover at least partially circumscribed by the frame and having a shape at least partially defined by the shape of the outer perimeter of the frame. The screen still further includes a first and a second mounting assembly configured to attach the frame to a generally horizontal surface. The method includes installing the screen on an article of furniture. Installing the screen includes mounting the frame to the first mounting assembly, mounting the frame to the second mounting assembly, and mounting the first and the second mounting assemblies to an article of furniture. The method further includes positioning the screen to increase the level of privacy provided by the screen.

DETAILED DESCRIPTION OF THE PREFERRED EMBODIMENTS

Figure 1:
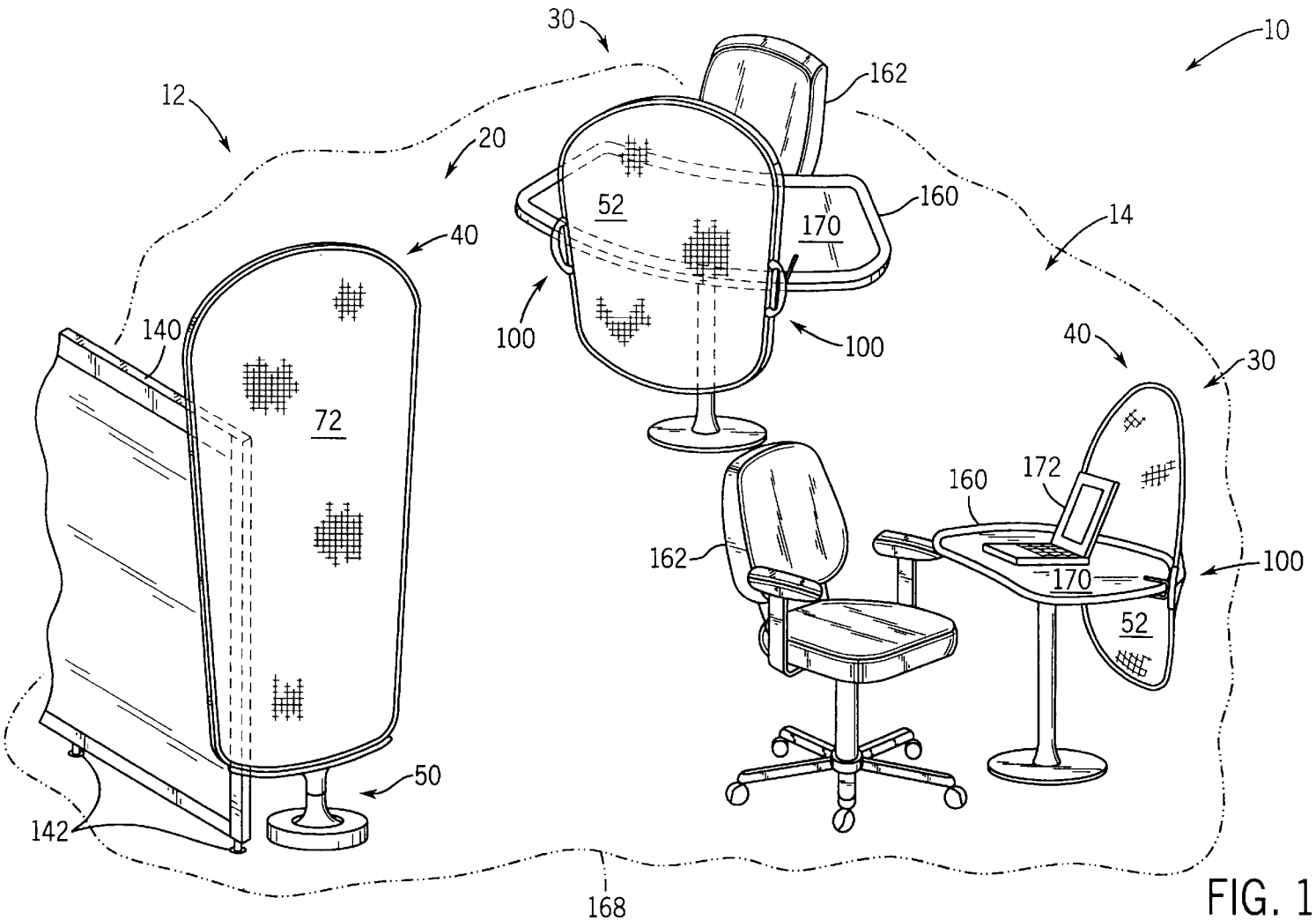
FIG. 1 is a perspective view of a work environment providing screens according to an exemplary embodiment of the present invention.

Referring to FIG. 1, a work environment 10 is shown. Work environment 10 includes a freestanding screen 20 and a worksurface-mounted screen 30, each providing a frame 40 that surrounds a cover (shown as a web 72). Frame 40 of screen 20 is attached to a mounting assembly 50, which is freestanding on a generally horizontal surface (shown as a floor 168). Frame 40 of screen 30 is attached to a mounting assembly 100, which is attached to an article of furniture (shown as a table 160) providing a worksurface 170.

Figures 2A, 3, 4A:
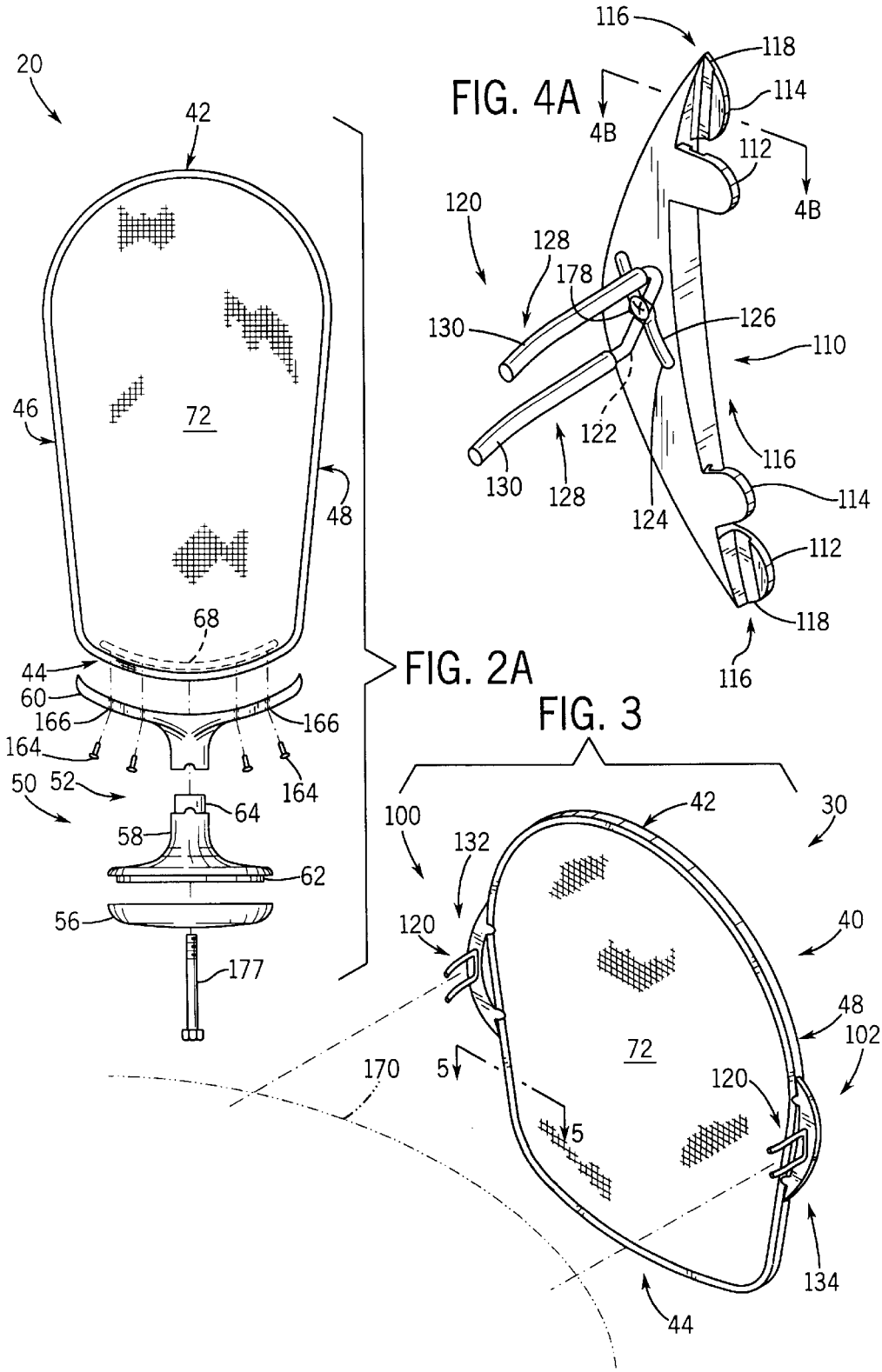
FIG. 2A is an exploded perspective view of a freestanding screen according to an exemplary embodiment of the present invention.
FIG. 3 is an exploded perspective view of a worksurface-mounted screen according to an exemplary embodiment of the present invention.
FIG. 4A is a perspective view of a mounting assembly associated with a worksurface-mounted screen according to an exemplary embodiment of the present invention.

Frame 40 includes a top member 42, a bottom member 44, a left middle member 46 and a right middle member 48 (as shown in FIG. 2A). As shown in FIG. 1, top member 42, bottom member 44, and left and right middle members 46 and 48 of frame 40 stretch web 72 such that web 72 spans the space from top member 42 to bottom member 44. The shape of frame 40 defines the shape of web 72. According to any alternative or preferred embodiments, the web associated with the frame is constructed of a fabric material (although a wide variety materials such as mesh, cloth, polyester/cotton, nylon, plastic, etc. may be used) or the like that is flexible (such that the web tends to return to original shape after being deformed) and lightweight. According to a preferred embodiment as shown in the FIGURES, web 72 is taut and free from wrinkles. According to a preferred embodiment the frame is constructed of a single piece, although the frame may be constructed of a number of pieces fastened together.

Figure 5:
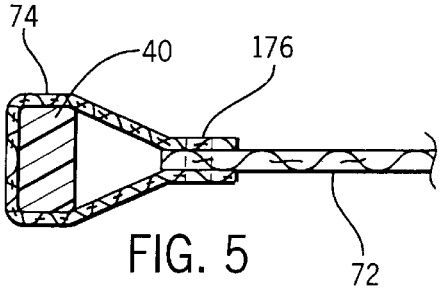
FIG. 5 is a sectional view of the screen of FIG. 3 taken along line 5—5 in FIG. 3.

According to an alternative embodiment as shown in FIG. 5, a binding 74 surrounds frame 40. Binding 74 restricts frame 40 from losing its shape and from extending beyond the limits of binding 74. A fastener (shown as a stitch 176) secures web 72 to binding 74. According to other alternative embodiments, a fastener may attach the web directly to the frame. According to other alternative and preferred embodiments, the web and the binding may be constructed of fabric material such as neoprene, polyester or nylon, although other suitable bindings (e.g., hooks, buttons, snaps, VELCRO (TM) fasteners, molded plastic, stitching, enveloping web, etc.) may be used to associate the web with the frame. According to an alternative embodiment, the web may be constructed of a flame retardant material or a substantially rigid material.

Figure 2B:
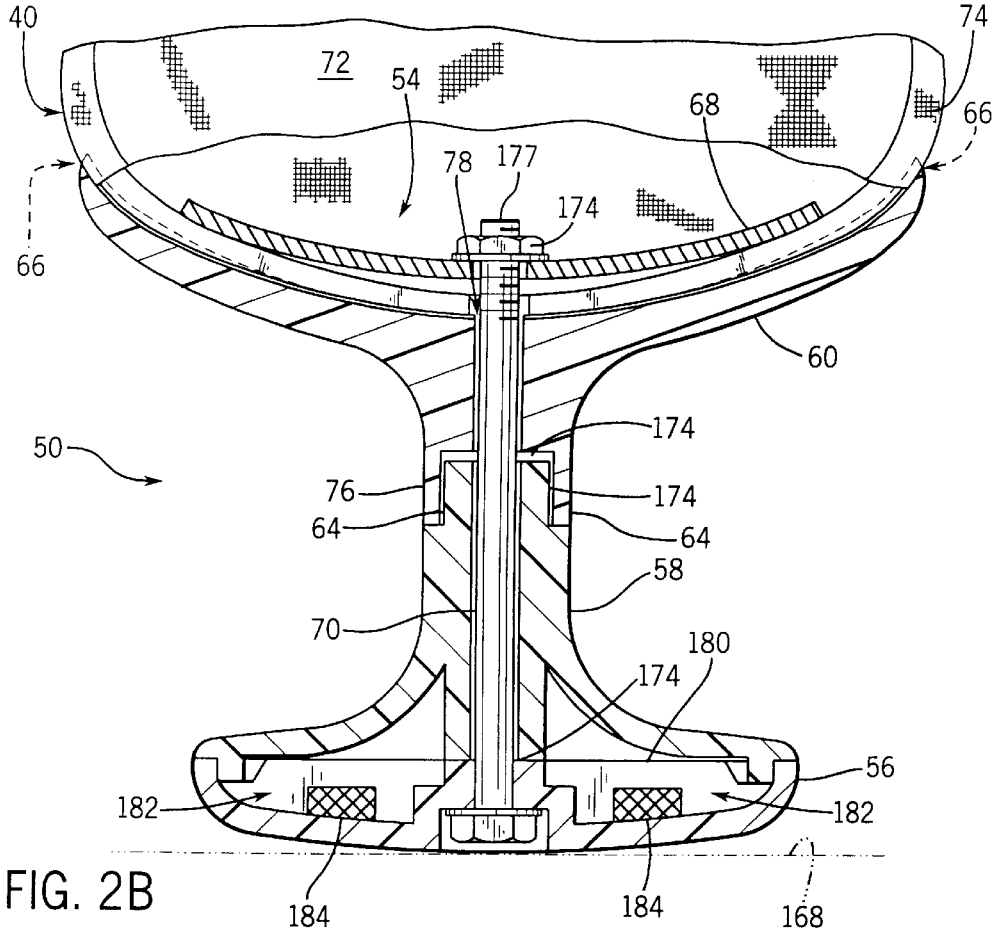
FIG. 2B is a side elevational view of a mounting assembly associated with the freestanding screen of FIG. 2A.
Figure 4B:
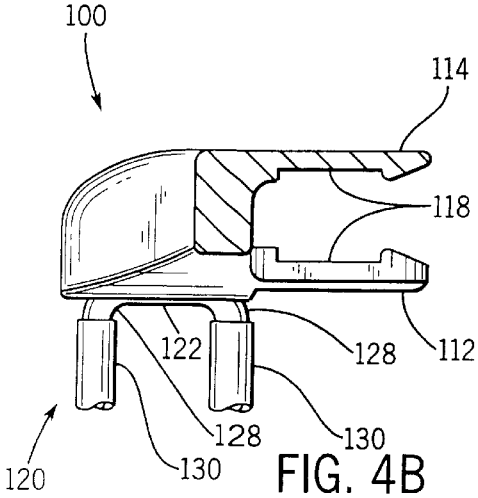
FIG. 4B is a sectional view of the mounting assembly of FIG. 4A taken along line 4B—4B in FIG. 4A.

Referring to FIGS. 2A and 2B, the attachment of frame 40 to mounting assembly 50 is shown according to an exemplary embodiment of the present invention. Mounting assembly 50 includes a bottom portion (shown as an I-shaped support 52) and a top portion (shown as an arc-shaped member 54). I-shaped support 52 of mounting assembly 50 includes a base (shown as a foot 56), a stand 58 and an arm 60, each telescopically aligned about a hole 174. According to alternative embodiments as shown in FIGS. 2A and 2B, the interior of foot 56 is hollow and may include a divider 180 that defines a cavity 182, within which may be provided with a ballast or a weight 184, such that mounting assembly 50 may tip slightly (or "wobble") when screen 20 is repositioned but tends to automatically return to an upright position. According to a preferred embodiment as shown in the FIGURES, foot 56 is oval-shaped (although according to alternative embodiments the base may be provided in a variety of other shapes and forms). I-shaped support 52 of mounting assembly 50 further includes stand 58 providing a rim 62, which is circumscribed and engaged by the interior of foot 56, and a step member 64. I-shaped support 52 of mounting assembly 50 still further includes arm 60 providing a protrusion 76. Protrusion 76 circumscribes and engages step 64 of stand 58. 30 Arm further provides a channel 66, which engages I-shaped support 52 of frame 40. Arc-shaped member 54 of mounting assembly 50 includes a brace 68 having hole 174. A tensioning device (shown as a threaded rod 70) secured by a fastener (shown as a bolt 177) compresses brace 68 to engage I-shaped support 52 of frame 40 in channel 66 of arm 60 so that mounting assembly 50 supports frame 40. Rod 70 also compresses mounting assembly 50 such that brace 68 engages I-shaped support 52. According to a preferred embodiment as shown in FIG. 2B, brace 68 is constructed of metal and has the same cross-section as does frame 40 (i.e., rectangular) such that brace 68 is flush against I-shaped support 52 of frame 40 and surrounded by binding 74. According to an alternative embodiment as shown in FIG. 2B, frame 40 is partially inserted in channel 66. According to a preferred embodiment, the frame is inserted completely within the channel. According to an alternative embodiment as shown in FIG. 2B, frame 40 of screen 20 includes a gap 78 through which rod 70 is inserted. According to other alternative embodiments as shown in FIG. 2A, frame 40 of screen 20 may be attached to mounting assembly 50 by fasteners (shown as screws 164) inserted through holes 166.

Referring to FIG. 3, frame 40 of screen 30 is shown attached to mounting assembly 100, and mounting assembly 100 is attached to worksurface 170 according to an exemplary embodiment of the present invention. As shown in FIG. 4A, mounting assembly 100 includes a housing assembly 110 and a bracket assembly 120. Housing assembly 110 is generally arc-shaped and includes interior flange 112 and exterior flange 114. Interior flange 112 and exterior flange 114 provide a channel 116, in which frame 40 may be inserted, such that interior and exterior flanges 112 and 114 engage frame 40. According to an alternative embodiment as shown in FIG. 4A, interior and exterior flanges 112 and 114 include an indentation 118 into which frame 40 is inserted so that frame 40 is fixedly engaged in channel 116. Housing 110 further includes a left recess 122 and a right recess 124. According to a preferred embodiment as shown in FIG. 4A, left recess 122 and right recess 124 intersect. Bracket assembly 120 is generally U-shaped and includes a vertical member 126 and a horizontal member (shown as a finger 128). Vertical member 126 of bracket assembly 120 is mounted to left recess 122 of housing 110 by a fastener (shown as a screw 178) so that mounting assembly 100 is in a left configuration 132. According to an alternative embodiment as shown in FIG. 3, vertical member 126 of bracket assembly 120 may be attached to right recess 124 of housing assembly 110 so that mounting assembly 100 is in a right configuration 134. Finger 128 engages the top and the bottom of worksurface 170 to attach mounting assembly 100 to worksurface 170. According to an alternative embodiment as shown in FIG. 4A, a covering (shown as a glove 130) surrounds finger 128 to increase the engagement of finger 128 with worksurface 170 and to protect worksurface 170 from being scratched by finger 128. According to an alternative embodiment as shown in FIG. 3, screen 30 includes two mounting assemblies 100 and 102 that engage opposing left and right middle members 46 and 48 of frame 40 to restrict screen 30 from pivoting about worksurface 170. According to other alternative embodiments of the present invention, the worksurface-mounted screen may be attached to a vertical surface such as a wall, a door, the backrest of a chair, etc. According to other alternative embodiments, the mounting assembly may be provided with guides to organize, guide, tether, and/or redirect cabling (e.g., wires from a computer may be attached to the mounting assembly and be guided to the floor). According to other alternative embodiments, the cabling may rest inside the mounting assembly or inside flexible inserts of the mounting assembly (e.g., ridges, dimples, teeth, etc.), such that the cabling is not disturbed when the screen is removed from the mounting assembly.

Figure 8:
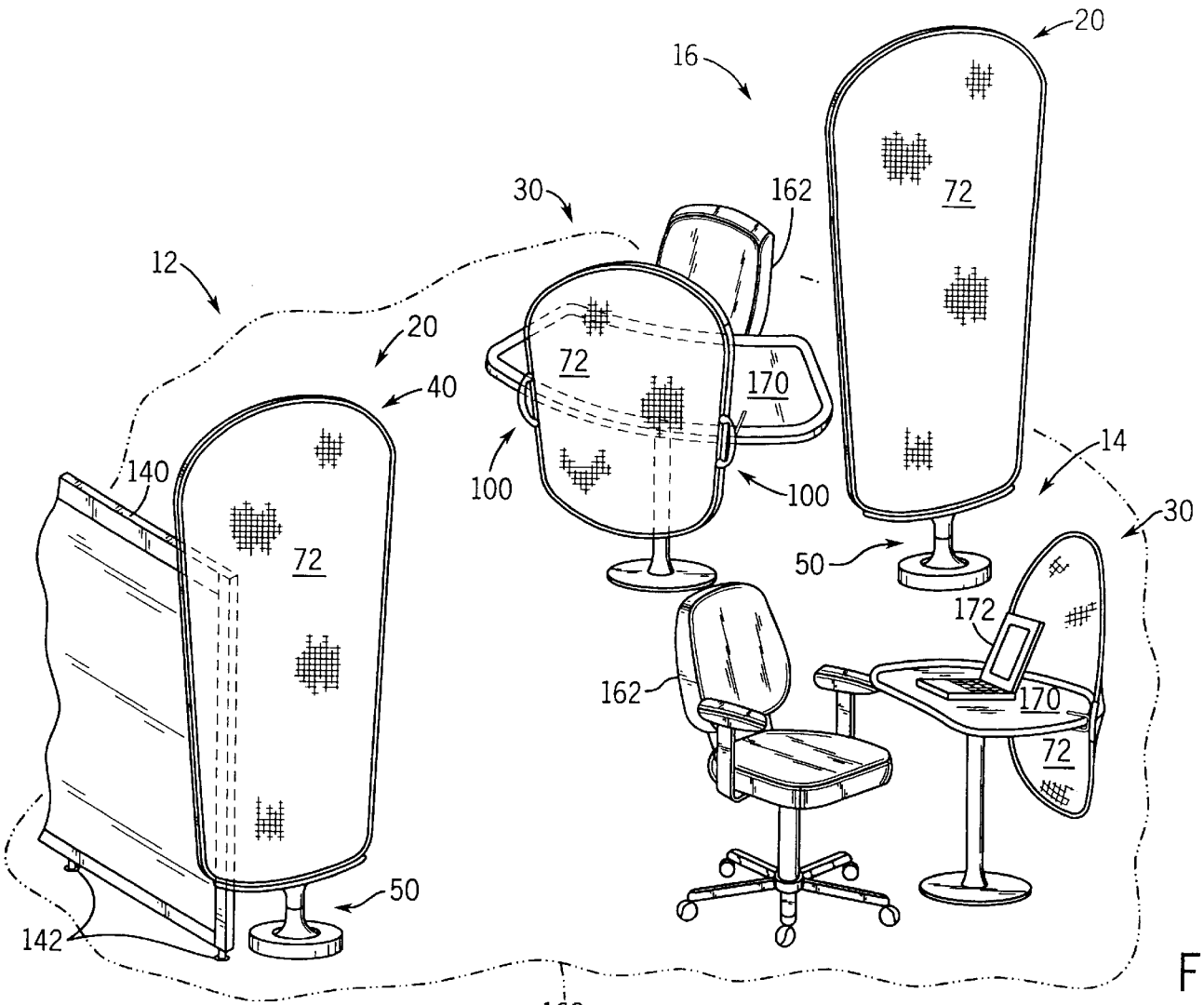
FIG. 8 is a perspective view of a work environment providing screens according to an exemplary embodiment of the present invention.

Screens 20 and 30 may be arranged to divide space in work environment 10. Referring to FIG. 1, screen 20 is positioned adjacent a partition 140 having a height adjustment mechanism 142 to define a work space 12. Screen 30 is positioned adjacent a seating product (shown as a chair 162) to define a work space 14. Both screens 20 and 30 are portable, so that a worker may reposition the screens to provide space division as required. For example, a worker may move screen 20 from work space 12 to any position on floor 168 of work space 14. Likewise, a worker may detach screen 30 from table 160 and mount screen 30 to another worksurface. Referring to FIG. 8, a screen may be added to reconfigure work environment 10 to create a work space 16.

Screens 20 and 30 may be selectively repositioned to redirect the amount of visual privacy desired in work environment 10. For example, screen 30 provides visual privacy to a worker (not shown) situated in chair 150 and to an accessory (shown as a computer 172) situated on table 160 (see FIG. 1). According to alternative embodiments, the worksurface-mounted screen is vertically repositionable within the mounting assembly to increase or decrease the extent to which the screen is positioned above and below the worksurface. To vertically reposition the worksurface-mounted screen, the mounting assembly is positioned offset a vertical distance from the middle members of the frame. Such repositioning may require adjustment of the mounting assembly along the worksurface depending on the shape of the screen and the structure of the mounting assembly. According to an alternative embodiment, the mounting assemblies associated with the worksurface-mounted screen may be positioned adjacent each other to compress the screen to a deformed configuration. According to other alternative embodiments, the screen may be selectively adjusted or repositioned, for example, about the perimeter of the table.

Figure 6:
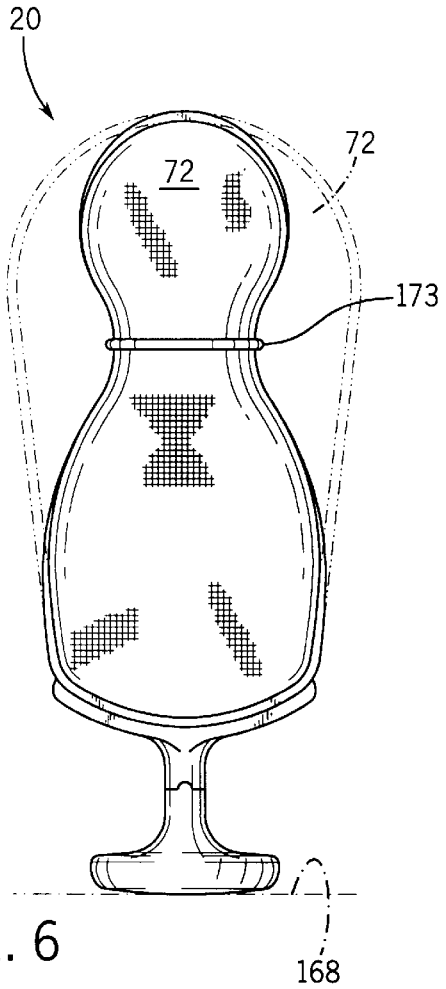
FIG. 6 is a side elevational view of a freestanding screen in a deformed configuration according to an exemplary embodiment of the present invention.

According to any preferred embodiment, the frame of the screen is constructed of a flexible, pliable, bendable material such that the frame and the associated web tend to return to original shape after being deformed, bent, pushed, or reshaped. The frame of the screen may be selectively deformed to various shapes and configurations to achieve the degree of visual privacy or space division desired by a worker. Referring to FIG. 6, freestanding screen 20 is shown in a deformed shape (in solid lines depicting a deformed configuration 94) and in non-deformed shape (in phantom lines depicting a use configuration 92). A tensioning member that which may have elastic characteristics such as a string, a strap, a cinch, etc. and shown as a band 174 may engage frame 40 to deform the shape of screen 20. According to a preferred embodiment as shown in FIG. 1, freestanding screen 20 in use configuration 92 provides for visual privacy over an area comparable to the area of a worker's body. When screen 20 is deformed to deformed configuration 94 (as shown in FIG. 6), screen 20 provides for visual privacy over a reduced or redirected area relative to use configuration 92. According to alternative embodiments of the present invention, the deformation of the shape of the screen may be configured to redirect the flow of traffic in the work environment or may be configured as a display or information containing device.

Figure 7A:
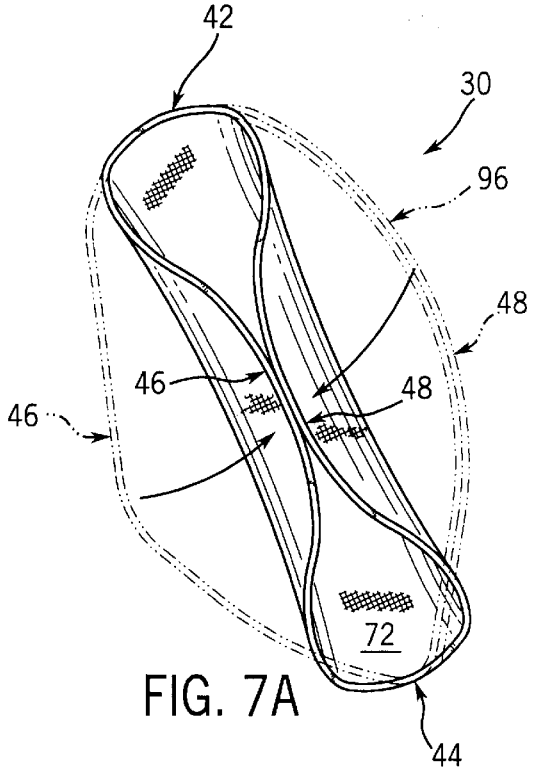
FIG. 7A is a top plan view of a worksurface-mounted screen deformed from a use configuration according to an exemplary embodiment of the present invention.
Figure 7B:
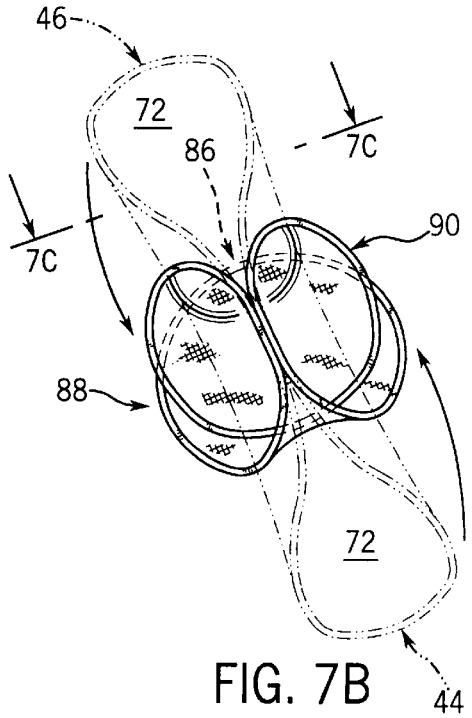
FIG. 7B is a top plan view of the screen of FIG. 7A in a tri-hoop configuration.
Figure 7C:
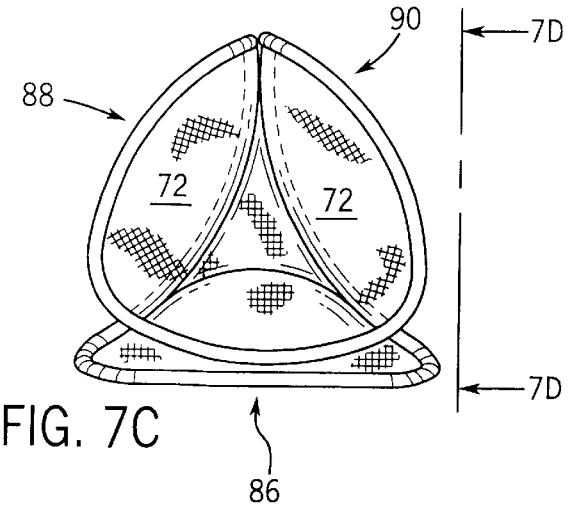
FIG. 7C is a side elevational view of the screen of FIG. 7B taken along line 7C—7C in FIG. 7B.
Figure 7D:
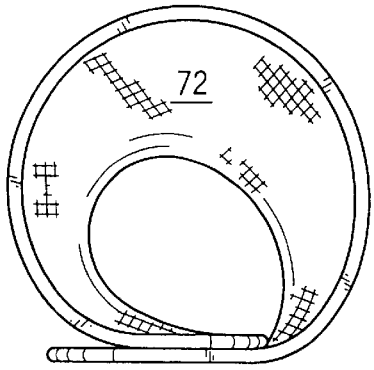
FIG. 7D is a side elevational view of the screen of FIG. 7C taken along line 7D—7D in FIG. 7C.
Figure 7E:
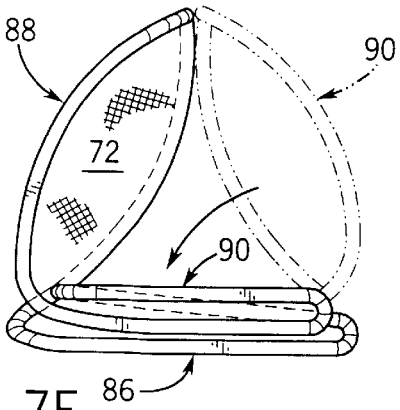
FIGS. 7E and 7F are side elevational views of the screen of FIG. 7C in a deformed configuration.
Figure 7F:
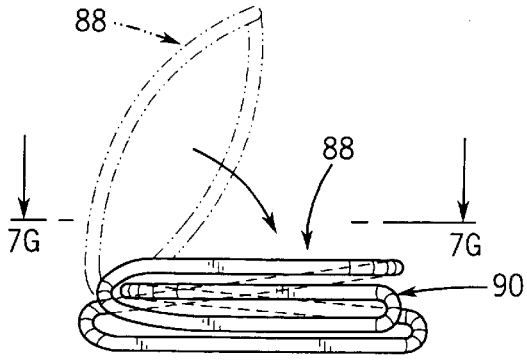
Figure 7G:
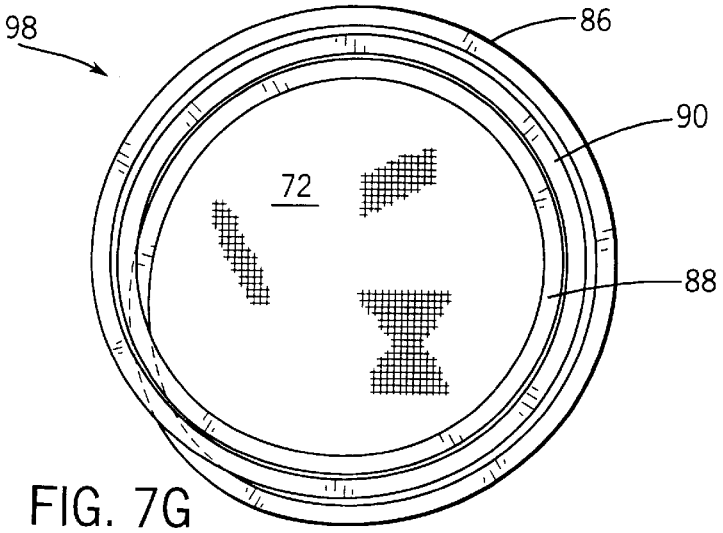
FIG. 7G is a top plan view of the screen of FIG. 7F taken along line 7F—7F in FIG. 7F.

Deformation of the frame of the screen may make the screen more compact for storage. Referring to FIGS. 7A through 7G, worksurface-mounted screen 30 is shown being selectively configured from a use configuration 96 (as shown in phantom lines in FIG. 7A) to a stowed configuration 98 (as shown in FIG. 7G) according to an exemplary embodiment of the present invention. When it is desired to deform screen 30 for storage, frame 40 is removed from channel 116 of mounting assembly 100. As shown in FIG. 7A, screen 30 is deformed so that both left and right middle members 46 and 48 of frame 40 are adjacent to each other. Bottom member 44 of frame 40 is positioned under top member 42 of frame 40 (as shown in FIG. 7B) such that frame 40 is configured in a tri-hoop configuration (as shown in FIGS. 7B through 7G) providing a base hoop 86 associated with top member 42 of frame 40, a left hoop 88 associated with left middle member 46 of frame 40 and a right hoop 90 associated with the right middle member 48 of frame 40. Base hoop 86 is substantially positioned under right hoop 90 (see FIG. 7E), and right hoop 90 is substantially positioned under left hoop 88 (see FIGS. 7E and 7F), such that base hoop 86 and left hoop 88 "sandwich" right hoop 90 as shown in FIGS. 7E through 7G. According to an alternative embodiment as shown in FIGS. 7A though 7G, frame 40 may be deformed or drawn into an approximate "figure-8" configuration (not shown) to form base hoop 86, left hoop 88 and right hoop 90 (as shown in FIGS. 7B through 7G), so that base hoop 86 and left hoop 88 may "sandwich" right hoop 90 to form screen 30 in stowed configuration 98 (as shown in FIG. 7G). When it is desired to expand frame 40 of screen 30 from stowed configuration 98 (as shown in FIG. 7G) to use configuration 96 (as shown in FIGS. 3 and 7A), base hoop 86 is positioned away from and left hoop 88 so that frame 40 may automatically reform into use configuration 96. According to a preferred embodiment as shown in FIG. 7G, base hoop 86, left hoop 88 and right hoop 90 are of substantially equal sizes. According to an alternative embodiment, the frame of the screen may be selectively removed (or inserted into) from the binding for storage (or replacement) of the web. According to other alternative embodiments, the frame and the web associated with the frame may be removed from or interchanged within the mounting structure. According to other alternative embodiments, the web associated with the frame may be removed from or interchanged within the frame.

As is shown in the FIGURES, the screens may be provided in any of a variety of heights, widths, sizes, shapes, structures or configurations. According to an alternative embodiment, the screen may have a generally round canister structure (e.g., hanging rolled projector screen, rolled map, window covering, etc.) that is mounted to a generally planar surface. According to other alternative embodiments, the web associated with the screen extends and retracts from a take-up reel of the canister, and the web may be connected to an adjacent member (e.g., another canister, pole, worksurface, wall, etc.) by a fastener (e.g., clip, VELCRO (TM) fastener, adhesive, snap, button, zipper, pin, etc.). According to a particularly preferred embodiment, the frame of the freestanding screen is generally rectangular-shaped, has an approximate height of 60 inches, an approximate width of 34 inches and has a narrower width at the bottom member of the frame than at the top member of the frame. The frame of the worksurface-mounted screen has a generally rectangular cross-section, has an approximate height of 36 inches, an approximate width of 30 inches and has a narrower width at the bottom member of the frame than at the top member of the frame. (These dimensions are approximate and may vary according to the particular application or installation.) According to a particularly preferred embodiment, the frame of the screen is constructed of spun fiberglass or spring steel having a generally rectangular cross-section and molded into a predetermined shape. According to a particularly preferred embodiment, the web of the screen is constructed of an opaque polyester-based "Stretch Mesh" material, Style No. 694816 (or alternatively Style No. 210575) commercially available from Milliken and Company of Grand Rapids, Mich. (although translucent or transparent materials may also be used). According to a particularly preferred embodiment, the binding is constructed of quilt binding polyester/cotton material having three folds. According to a particularly preferred embodiment, the base and the stand of the mounting assembly are constructed of metal and the arm of the mounting assembly is constructed of molded plastic. According to a particularly preferred embodiment, the base of the mounting assembly of the floorstanding screen is curved, such that the base may glide across a horizontal surface when moved. According to a particularly preferred embodiment, the mounting assembly of the freestanding screen is mounted to the frame of the screen by a threaded steel rod inserted through the base, the stand, the arm, the gap in the frame and the brace, and fastened by a threaded nut. According to a particularly preferred embodiment, the glove is constructed of rubber, but other materials such as foam or fabric may be used.

According to any preferred embodiment, the screen has a "modular" construction, with elements that are capable of assembly and arrangement in any of a variety of shapes, sizes, configurations and combinations, and suitable for use in a wide variety of work environments and in association with any of a wide variety of articles of (such as panel wall systems, storage products, seating products, workstations, worksurfaces, screens, etc.).

As will become apparent to those who review this disclosure, FIGS. 1 and 8 are schematic only and the nature or extent of the work space division and visual privacy provided by the screens can be varied depending upon the height, width, shape, handedness or configurations of the screens, the number of screens used in combination (e.g., "hotelling"), as well as their arrangement and position (alone or in association with other articles of furniture of various heights and widths). The screens may be associated with any type of article of furniture according to other exemplary embodiments, and may be provided with an ornamental appearance intended to fit or "match" with the ornamental appearance of one or more associated articles of furniture. As will be understood by those who review this disclosure, any mounting assembly may be used to attach the worksurface-mounted screen to the frame and a worksurface (e.g., hinged clips, spring clips, friction clips, buttons, snaps, repositionable insert rods, VELCRO (TM) fastener, slide rail, cantilever assembly, etc.).

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims.

What is claimed is:

1. An apparatus for providing visual privacy in a work environment having a worksurface comprising:

a transportable screen including:

a flexible frame providing an outer perimeter defining a shape and comprising a continuous, flexible spring metal member;

a generally flexible web at least partially circumscribed by the frame and having a shape corresponding to the shape of the frame;

a mounting assembly attached to the frame for coupling the screen to the worksurface comprising:

a first bracket assembly adapted for coupling the screen to the worksurface at a first position and a second bracket assembly adapted for coupling the screen to the worksurface at a second position;

a housing having a channel for receiving the frame, the cannel disposed between at least one interior flange and at least one exterior flange relative to the worksurface;

wherein the screen is selectively reconfigurable to divide a space within the work environment and is adapted for selective repositioning between a first vertical position and a second vertical position relative to the worksurface, and wherein the screen is deformable from a first shape to a second shape and tends to reform to an original shape after being deformed.

2. The apparatus of claim 1 wherein the first shape is an expanded configuration and the second shape is a collapsed configuration.

3. The apparatus of claim 2 wherein the first shape provides greater visual privacy than the second shape.

4. The apparatus of claim 2 wherein reconfiguration of the screen redirects a flow of traffic in the work environment.

5. The apparatus of claim 3 wherein the frame is deformable and tends to reform to an original shape after being deformed.

6. The apparatus of claim 5 wherein deformation of the frame decreases a relative level of visual privacy provided by the screen.

7. The apparatus of claim 6 wherein the screen in a non-use configuration is folded upon itself.

8. The apparatus of claim 7 wherein the screen is configured for selective repositioning within the mounting assembly between a first position and a second position relative to the worksurface.

9. The apparatus of claim 8 wherein a first portion of the screen is adapted for selective positioning above the worksurface and a second portion of the screen is adapted for selective positioning below the worksurface.

10. The apparatus of claim 9 wherein the frame is adapted for direct attachment to the worksurface by the mounting assembly.

11. The apparatus of claim 6 wherein the frame comprises a segmented member.

12. The apparatus of claim 11 wherein the frame comprises a plurality of interconnected flexible segments.

13. The apparatus of claim 12 wherein the frame comprises a generally elongate member having a substantially rectangular shaped cross-section.

14. The apparatus of claim 6 wherein the web comprises a fabric material.

15. The apparatus of claim 14 wherein the web is generally opaque.

16. The apparatus of claim 6 wherein the interior flange comprises a recessed portion for receiving the frame such that the frame is configured for an interference fit within the recess.

17. The apparatus of claim 16 wherein the housing comprises an indentation configured to engage a mounting clip.

18. The apparatus of claim 17 wherein the indentation is generally X-shaped and the mounting clip is selectively configurable between a first clip position and a second clip position relative to the generally X-shaped recessed portion.

19. The apparatus of claim 6 wherein the housing comprises a generally crescent-shape.

20. The apparatus of claim 6 wherein the housing comprises a U-shape.

21. The apparatus of claim 6 further comprising a protective member at least partially covering the housing.

22. An apparatus for providing visual privacy in a work environment having a generally horizontal surface comprising:

a transportable screen including:

a continuous deformable frame providing an outer perimeter adapted to be deformed from to a first shape to at least one second shape and comprising a flexible, unitary member;

a web at least partially circumscribed by the frame and having a shape at least partially defined by the shape of the outer perimeter of the frame and comprising a substantially rigid material;

a mounting assembly configured to support the frame on the generally horizontal surface;

wherein the first shape provides greater visual privacy than the second shape within the work environment and the first shape visually shrouds a greater area than the second shape of the screen.

23. The apparatus of claim 22 wherein the first shape is an expanded configuration and the second shape is a collapsed configuration.

24. The apparatus of claim 23 wherein the first shape provides greater visual privacy than the second shape.

25. The apparatus of claim 24 wherein the first shape is relatively planar.

26. The apparatus of claim 24 wherein deformation of the frame decreases a relative level of visual privacy provided by the screen.

27. The apparatus of claim 24 wherein the screen in a non-use configuration is folded upon itself.

28. The apparatus of claim 27 wherein the screen is configured for selective repositioning within the mounting assembly between a first position and a second position relative to the horizontal surface.

29. The apparatus of claim 22 wherein a first portion of the screen is adapted for selective positioning above the horizontal surface and a second portion of the screen is adapted for selective positioning below the horizontal surface.

30. The apparatus of claim 27 wherein reconfiguration of the screen redirects a flow of traffic in the work environment.

31. The apparatus of claim 30 wherein the screen is deformable and tends to reform to an original shape after being deformed.

32. The apparatus of claim 31 wherein the web includes a generally flexible material.

33. The apparatus of claim 32 wherein the web is generally opaque.

34. The apparatus of claim 32 wherein the web is generally translucent.

35. The apparatus of claim 32 wherein the frame is adapted for direct attachment to the worksurface by the mounting assembly.

36. The apparatus of claim 35 wherein the frame comprises a segmented member.

37. The apparatus of claim 36 wherein the frame comprises a plurality of interconnected flexible segments.

38. The apparatus of claim 35 wherein the mounting assembly comprises a mounting bracket.

39. An apparatus for providing visual privacy in a work environment having a generally horizontal surface comprising:

a transportable screen including:

a continuous deformable frame providing an outer perimeter adapted to be deformed from a first shape to at least one second shape and comprising a flexible, unitary member;

a web at least partially circumscribed by the frame and having a shape at least partially defined by the shape of the outer perimeter of the frame;

a mounting assembly configured to support the frame on the generally horizontal surface and including a ballast material;

wherein the first shape provides greater visual privacy than the second shape within the work environment and the first shape visually shrouds a greater area than the second shape of the screen.

40. The apparatus of claim 39 wherein the first shape is an expanded configuration and the second shape is a collapsed configuration.

41. The apparatus of claim 40 wherein the first shape provides greater visual privacy than the second shape.

42. The apparatus of claim 41 wherein the first shape is generally planar.

43. The apparatus of claim 41 wherein deformation of the frame decreases a relative level of visual privacy provided by the screen.

44. The apparatus of claim 43 wherein the screen in a non-use configuration is folded upon itself.

45. The apparatus of claim 44 wherein the screen is configured for selective repositioning within the mounting assembly between a first position and a second position relative to the horizontal surface.

46. The apparatus of claim 45 wherein a first portion of the screen is adapted for selective positioning above the horizontal surface and a second portion of the screen is adapted for selective positioning below the horizontal surface.

47. The apparatus of claim 44 wherein reconfiguration of the screen redirects a flow of traffic in the work environment.

48. The apparatus of claim 44 wherein the screen is deformable and tends to reform to an original shape after being deformed.

49. The apparatus of claim 48 wherein the web comprises a generally flexible material.

50. The apparatus of claim 49 wherein the web is generally translucent.

51. The apparatus of claim 48 wherein the frame is adapted for direct attachment to the horizontal surface by the mounting assembly.

52. The apparatus of claim 51 wherein the frame comprises a segmented member.

53. The apparatus of claim 52 wherein the frame comprises a plurality of interconnected flexible segments.

54. The apparatus of claim 48 wherein the ballast material is in the mounting assembly.

55. The apparatus of claim 54 wherein the mounting assembly is configured to support the frame on a floor.

* * * * *